US011309646B2

(12) United States Patent
Ou et al.

(10) Patent No.: US 11,309,646 B2
(45) Date of Patent: Apr. 19, 2022

(54) ELECTRICAL CONNECTOR HAVING TERMINALS WITH REDUCED HEIGHT

(71) Applicant: LOTES CO., LTD, Keelung (TW)

(72) Inventors: Zi Sheng Ou, Keelung (TW); Chin Chi Lin, Keelung (TW); Chih Kun Chen, Keelung (TW)

(73) Assignee: LOTES CO., LTD, Keelung (TW)

( * ) Notice: Subject to any disclaimer, the term of this patent is extended or adjusted under 35 U.S.C. 154(b) by 62 days.

(21) Appl. No.: 16/887,325

(22) Filed: May 29, 2020

(65) Prior Publication Data

US 2021/0119360 A1 Apr. 22, 2021

(30) Foreign Application Priority Data

Oct. 22, 2019 (CN) ..... 201921780527.5

(51) Int. Cl.
*H01R 12/00* (2006.01)
*H01R 12/71* (2011.01)
*H01R 13/24* (2006.01)

(52) U.S. Cl.
CPC ..... *H01R 12/714* (2013.01); *H01R 13/2407* (2013.01)

(58) Field of Classification Search
CPC ..... H01R 12/714; H01R 13/2407; H01R 13/2442; H01R 13/41; H01R 23/722
See application file for complete search history.

(56) References Cited

U.S. PATENT DOCUMENTS 5,263,882 A * 11/1993 Peterson ..... H01R 13/41 439/733.1
6,585,527 B2 * 7/2003 Koopman ..... H01R 13/2435 439/66
6,942,495 B2 * 9/2005 Liao ..... H01R 13/2435 439/66
6,957,987 B2 * 10/2005 Ma ..... H01R 13/41 439/331

(Continued)

FOREIGN PATENT DOCUMENTS

CN 2932712 Y 8/2007
CN 200972922 Y 11/2007

(Continued)

*Primary Examiner* — Thanh Tam T Le
(74) *Attorney, Agent, or Firm* — Locke Lord LLP; Tim Tingkang Xia, Esq.

(57) ABSTRACT

An electrical connector includes a body having multiple accommodating holes running vertically therethrough, and multiple conductive terminals vertically movably accommodated in the accommodating holes. Each accommodating hole has upper and lower position limiting surfaces. Each conductive terminal includes a flat plate portion having an upper position limiting portion located above the upper position limiting surface, and a lower position limiting portion located below the lower position limiting surface, so as to limit a vertical movement of the conductive terminal. Upper and lower elastic arms are formed at a rear side the flat plate portion. Each of the upper and lower elastic arms has a corresponding contact portion to correspondingly abut a first electronic component and a second electronic component. A through slot extends from the upper elastic arm through the flat plate portion to the lower elastic arm.

15 Claims, 13 Drawing Sheets

(56) References Cited

U.S. PATENT DOCUMENTS

| | | | | |
|---|---|---|---|---|
| 7,052,284 | B2 * | 5/2006 | Liao | H01R 13/2435 439/66 |
| 7,097,517 | B2 * | 8/2006 | Ma | H01R 13/41 439/331 |
| 7,175,480 | B2 * | 2/2007 | Yamashita | H01R 13/41 439/733.1 |
| 7,297,010 | B2 * | 11/2007 | Tsai | H01R 13/2442 439/331 |
| 7,390,195 | B2 | 6/2008 | Liao | |
| 8,123,574 | B2 * | 2/2012 | Ma | H01R 13/422 439/862 |
| 8,192,206 | B1 * | 6/2012 | Ju | H01R 12/57 439/66 |
| 8,277,230 | B2 * | 10/2012 | Huo | H01R 12/73 439/66 |
| 8,323,038 | B2 * | 12/2012 | Jin | H01R 13/2442 439/83 |
| 8,899,993 | B2 * | 12/2014 | Taylor | H01R 43/16 439/66 |
| 9,172,161 | B2 | 10/2015 | Walden et al. | |
| 9,450,313 | B2 * | 9/2016 | Tsai | H01R 13/41 |
| 10,079,443 | B2 * | 9/2018 | Costello | H01R 13/2442 |
| 10,276,953 | B2 * | 4/2019 | Huang | H01R 12/57 |
| 10,424,858 | B2 * | 9/2019 | Ju | H01R 43/16 |
| 10,741,951 | B2 * | 8/2020 | Mason | H01R 43/0256 |
| 10,833,442 | B2 * | 11/2020 | Cheng | H01R 12/57 |

FOREIGN PATENT DOCUMENTS

| | | | |
|---|---|---|---|
| CN | 201699184 | U | 1/2011 |
| CN | 202564628 | U | 11/2012 |

* cited by examiner

C–C

ELECTRICAL CONNECTOR HAVING TERMINALS WITH REDUCED HEIGHT

CROSS-REFERENCE TO RELATED PATENT APPLICATION

This non-provisional application claims priority to and the benefit of, pursuant to 35 U.S.C. § 119(a), patent application Serial No. CN201921780527.5 filed in China on Oct. 22, 2019. The disclosure of the above application is incorporated herein in its entirety by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector, and particularly to an electrical connector having a conductive terminal capable of being compressed in two directions.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

A conventional electrical connector is used to electrically connect a chip module with a circuit board, and includes a body and multiple conductive terminals assembled on the body. Each conductive terminal has a base, and the base is provided with a barb protrusion in interference fit with the body to fix the conductive terminal to the body. An upper elastic arm is formed by bending and extending upward from an upper end of the base. The upper elastic arm can be elastically deformed to upward abut the chip module. A lower elastic arm is formed by bending and extending downward from a lower end of the base. The lower elastic arm can be elastically deformed to downward abut the circuit board. However, to ensure the elasticity of the upper elastic arms and the lower elastic arms so as to achieve good contact between the upper elastic arms and the chip module and good contact between the lower elastic arms and the circuit board, the upper elastic arms and the lower elastic arms need to have relatively great lengths. Thus, the conductive terminals have relatively great heights, which is unfavorable for ultra-thinning of the electrical connector.

Therefore, a heretofore unaddressed need to design an improved electrical connector exists in the art to address the aforementioned deficiencies and inadequacies.

SUMMARY

The present invention is directed to an electrical connector having terminals with a reduced height.

To achieve the foregoing objective, the present invention adopts the following technical solutions.

An electrical connector is configured to electrically connect a first electronic component with a second electronic component. The electrical connector includes: a body, having a plurality of accommodating holes running vertically therethrough, wherein each of the accommodating holes is provided with an upper position limiting surface and a lower position limiting surface; and a plurality of conductive terminals, vertically movably accommodated in the accommodating holes, wherein each respective conductive terminal of the conductive terminals comprises: a flat plate portion, protrudingly provided with an upper position limiting portion and a lower position limiting portion, wherein the upper position limiting portion is located above the upper position limiting surface, the lower position limiting portion is located below the lower position limiting surface, so as to limit a vertical movement of the respective conductive terminal; an upper elastic arm formed by bending and extending backward and upward from the flat plate portion, wherein the upper elastic arm has an upper contact portion configured to upward abut the first electronic component; and a lower elastic arm formed by bending and extending backward and downward from the flat plate portion, wherein the lower elastic arm has a lower contact portion configured to downward abut the second electronic component, the upper elastic arm and the lower elastic arm are both located at a rear side of the flat plate portion, and a through slot extends from the upper elastic arm through the flat plate portion to the lower elastic arm.

In certain embodiments, the upper position limiting portion and the lower position limiting portion protrude and extend from an inner side of the flat plate portion into the through slot, each of the accommodating holes is provided with a position limiting protruding block accommodated in the through slot, the upper position limiting surface is provided on an upper surface of the position limiting protruding block, and the lower position limiting surface is provided on a lower surface of the position limiting protruding block.

In certain embodiments, an upper protruding portion is formed by extending upward from the position limiting protruding block, a lower protruding portion is formed by extending downward from the position limiting protruding block, the upper protruding portion is located behind the upper position limiting portion, and the lower protruding portion is located behind the lower position limiting portion, so as to limit the flat plate portion from moving backward.

In certain embodiments, the conductive terminal has two lower position limiting portions extending from two opposite inner sides of the flat plate portion, and a distance between the two lower position limiting portions is less than a width of the position limiting protruding block.

In certain embodiments, each of the conductive terminals further has a strip connecting portion protruding and extending from an outer side of the flat plate portion to be connected to a strip, the body has a plurality of positioning slots recessed downward from an upper surface of the body, the strip connecting portion of each of the conductive terminals is accommodated in one of the positioning slots, and each of the positioning slots has an inner wall located behind the corresponding strip connecting portion to limit the corresponding strip connecting portion from moving backward.

In certain embodiments, the upper elastic arm forms two upper branches at two opposite sides of the through slot, an upper connecting portion connects the two upper branches, the upper contact portion protrudes upward from an upper surface of the upper connecting portion, a width of the upper contact portion is less than a width of the upper connecting portion, and a first interval exists between the upper contact portion and each of a left side edge and a right side edge of the upper connecting portion; and the lower elastic arm forms two lower branches at the two opposite sides of the through slot, a lower connecting portion connects the two lower branches, the lower contact portion protrudes downward from a lower surface of the lower connecting portion, a width of the lower contact portion is less than a width of the lower connecting portion, and a second interval exists between the lower contact portion and each of a left side edge and a right side edge of the lower connecting portion.

In certain embodiments, the upper elastic arm forms two upper branches at two opposite sides of the through slot, an upper connecting portion connects the two upper branches, the upper contact portion is formed by extending backward from the upper connecting portion, and a width of the upper contact portion is less than a width of the through slot; and the lower elastic arm forms two lower branches at the two opposite sides of the through slot, a lower connecting portion connects the two lower branches, the lower contact portion is formed by extending backward from the lower connecting portion, and a width of the lower contact portion is less than the width of the through slot. In certain embodiments, the upper position limiting portion and the lower position limiting portion protrude from an outer side of the flat plate portion, each of the accommodating holes is provided with a position limiting protruding block, the upper position limiting surface is provided on an upper surface of the position limiting protruding block, the lower position limiting surface is provided on a lower surface of the position limiting protruding block, and a width of the through slot is greater than a width of an overlapping portion of the position limiting protruding block and the lower position limiting portion in a vertical direction.

In certain embodiments, the upper elastic arm comprises an upper base bending backward from the flat plate portion and then extending horizontally, and an upper oblique portion extending upward and backward obliquely from the upper base, the upper contact portion is provided at a free tail end of the upper oblique portion, and the through slot extends to the upper base but does not reach the upper oblique portion.

In certain embodiments, each of the conductive terminals further has a strip connecting portion configured to be connected to a strip, the strip connecting portion is located above the upper position limiting portion, and an upper end of the strip connecting portion is higher than an upper end of the upper base.

Compared with the related art, certain embodiments of the present invention have the following beneficial effects. The flat plate portions of the conductive terminals are vertically movably limited in the accommodating holes, and in each conductive terminal, the through slot extends from the upper elastic arm through the flat plate portion to the lower elastic arm, such that the flat plate portions of the conductive terminals are elastic. That is, each of the conductive terminals is elastic through its entire length. Therefore, compared with the related art, the electrical connector can shorten the upper elastic arms and the lower elastic arms of the conductive terminals when the same elastic force is provided, thus reducing the heights of the conductive terminals, and facilitating ultra-thinning of the electrical connector. Further, in each conductive terminal, the through slot extends from the upper elastic arm through the flat plate portion to the lower elastic arm, such that the width of the flat plate portion is closer to the width of the upper elastic arm and the width of the lower elastic arm (relative to the situation where the through slot runs through the upper elastic arm and the lower elastic arm, but does not run through the flat plate portion), such that the impedance of each conductive terminal from the upper elastic arm through the flat plate portion to the lower elastic arm is relatively steady, which is conductive to improving high frequency. In addition, since the through slot can enhance the elasticity of the flat plate portion, in a process of downward inserting each conductive terminal into the corresponding accommodating hole, the lower position limiting portion provided on the flat plate portion does not damage the body easily.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
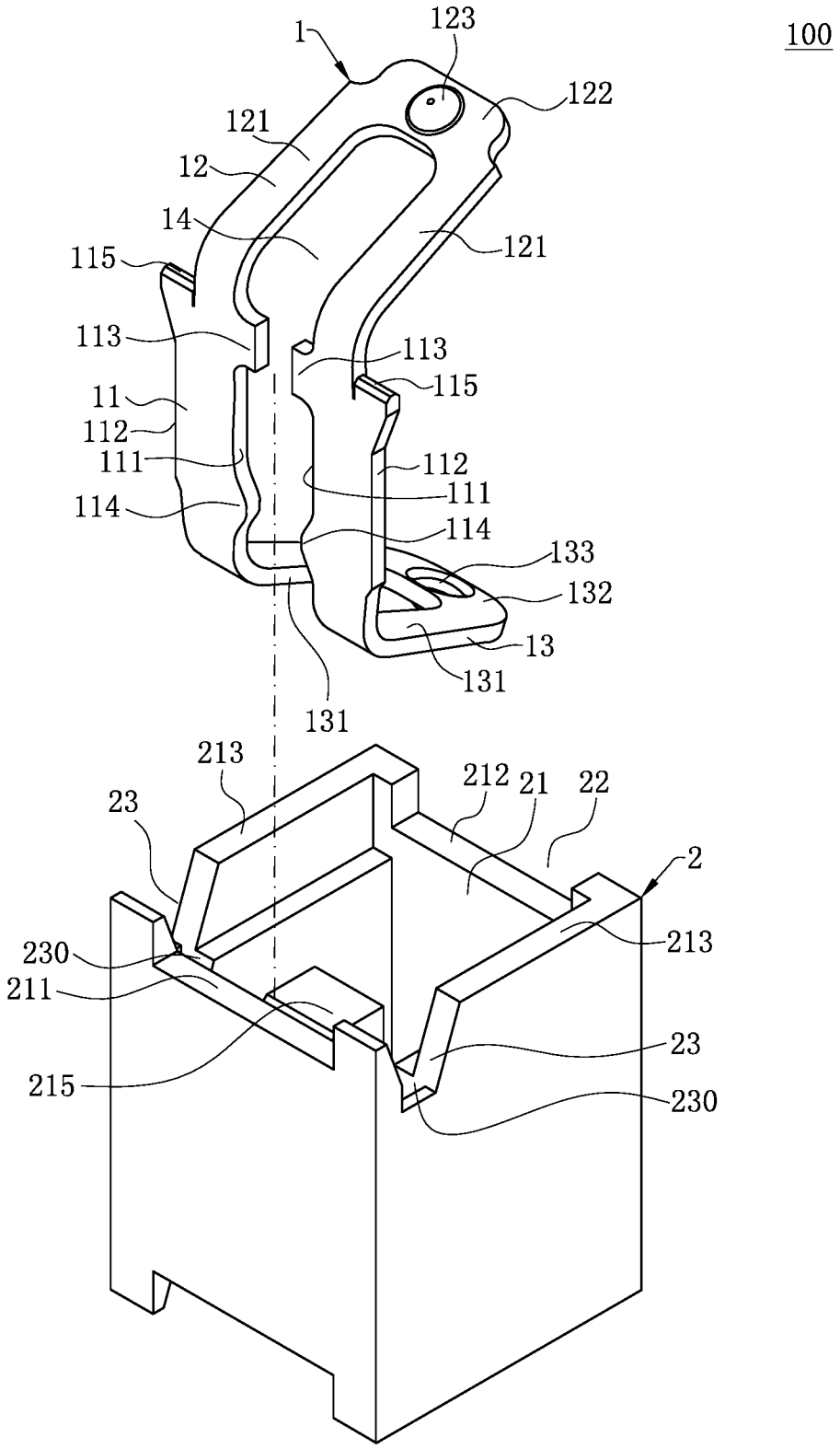
FIG. 1 is an exploded view of an electrical connector according to a first embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-13. In accordance with the purposes of this invention, as embodied and broadly described herein, this invention, in one aspect, relates to an electrical connector.

FIG. 1 shows an electrical connector according to a first embodiment of the present invention, which is used to connect a first electronic component 200 with a second electronic component 300 (also referring to FIG. 5), and includes multiple conductive terminals 1 (only one conductive terminal is shown for clarity) and a body 2 accommodating the conductive terminals 1. In the present embodiment, the first electronic component 200 is a chip module, and the second electronic component 300 is a circuit board.

As shown in FIG. 1, the conductive terminals 1 are formed by stamping a metal plate, and each conductive terminal 1 includes a flat plate portion 11 extending vertically, an upper elastic arm 12 connected to an upper end of the flat plate portion 11, a lower elastic arm 13 connected to a lower end of the flat plate portion 11, and a through slot 14 running through the conductive terminal 1 along a thickness direction. The through slot 14 extends from the upper elastic arm 12 through the flat plate portion 11 to the lower elastic arm 13.

As shown in FIG. 1, in a left-right direction, i.e., in a width direction of the flat plate portion 11, the flat plate portion 11 is divided by the through slot 14 into two parallel portions located at two sides of the through slot 14. Each portion has an inner side edge 111 facing the through slot 14 and an outer side edge 112 opposite to the inner side edge 111. Each inner side edge 111 is provided with an upper position limiting portion 113 and a lower position limiting portion 114 protruding toward the through slot 14. An edge of the lower position limiting portion 114 has a smooth contour. Each outer side edge 112 is provided with a strip connecting portion 115 protruding outward and configured to connect a strip 400 (also referring to FIG. 4). A height of the strip connecting portion 115 is substantially identical to a height of the upper position limiting portion 113.

As shown in FIG. 1, a thickness direction of the flat plate portion 11 is taken as a front-rear direction. The upper elastic arm 12 is formed by bending from the upper end of the flat plate portion 11 and extending backward and upward obliquely, and is U-shaped. That is, the upper elastic arm 12 includes two upper branches 121 connected to the flat plate portion 11 and located at the two sides of the through slot 14, and an upper connecting portion 122 connecting the two upper branches 121 at a free tail end of the upper elastic arm 12. The upper connecting portion 122 is provided with an upper contact portion 123 to upward abut the first electronic component 200 (also referring to FIG. 5). In the present embodiment, the upper contact portion 123 protrudes from an upper surface of the upper connecting portion 122 and is hemispherical. A width of the upper contact portion 123 is less than a width of the upper connecting portion 122, and a first interval exists between the upper contact portion 123 and each of left and right side edges of the upper connecting portion 122. The lower elastic arm 13 is formed by bending from a lower end of the flat plate portion 11 and extending backward and upward obliquely, and is U-shaped. That is, the lower elastic arm 13 includes two lower branches 131 connected to the flat plate portion 11 and located at the two sides of the through slot 14, and a lower connecting portion 132 connecting the two lower branches 131 at a free tail end of the lower elastic arm 13. The lower connecting portion 132 is provided with a lower contact portion 133 to abut the second electronic component 300 (also referring to FIG. 5). The lower contact portion 133 protrudes from a lower surface of the lower connecting portion 132 and is also hemispherical. A width of the lower contact portion 133 is less than a width of the lower connecting portion 132, and a second interval exists between the lower contact portion 133 and each of left and right side edges of the lower connecting portion 132. In the present embodiment, the lower elastic arm 13 and the upper elastic arm 12 are symmetrically provided. The upper contact portion 123 and the lower contact portion 133 are both located on a rear side of the flat plate portion 11.

Figure 2:
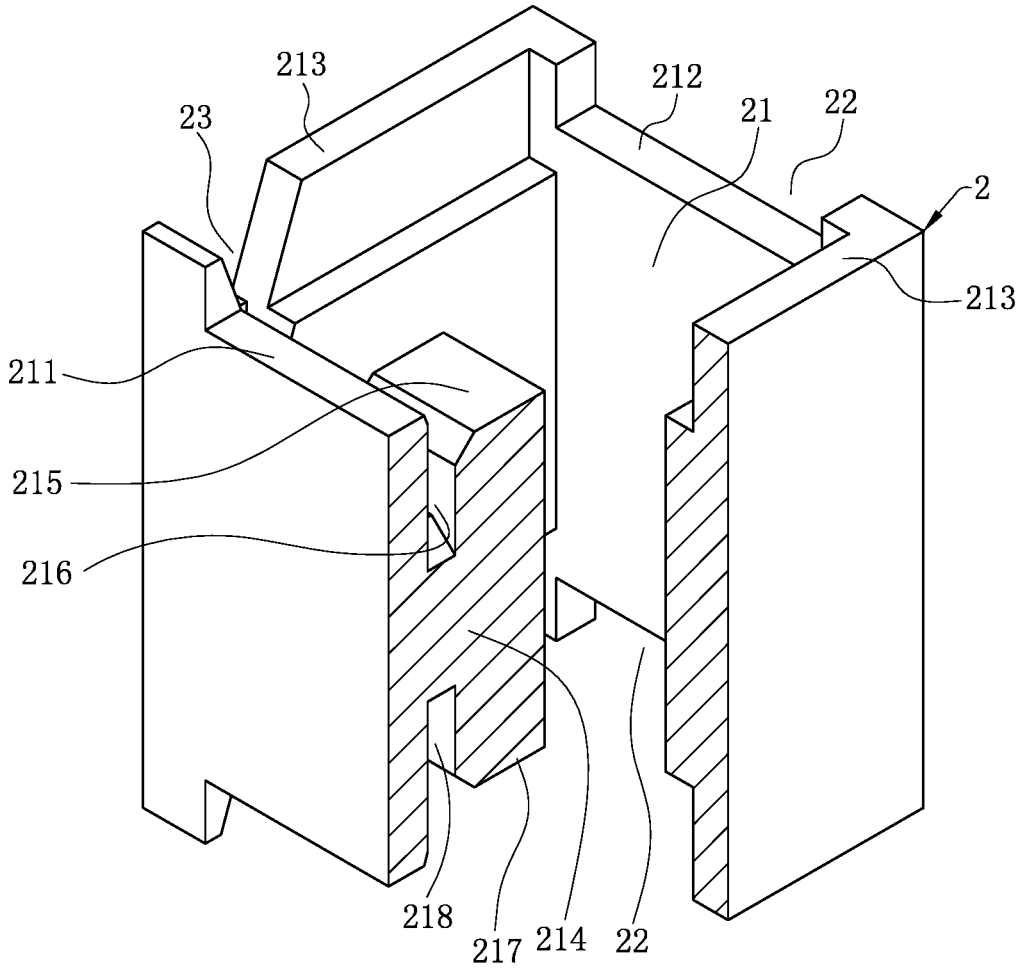
FIG. 2 is a partial sectional view of a body of the electrical connector in FIG. 1.
Figure 5:
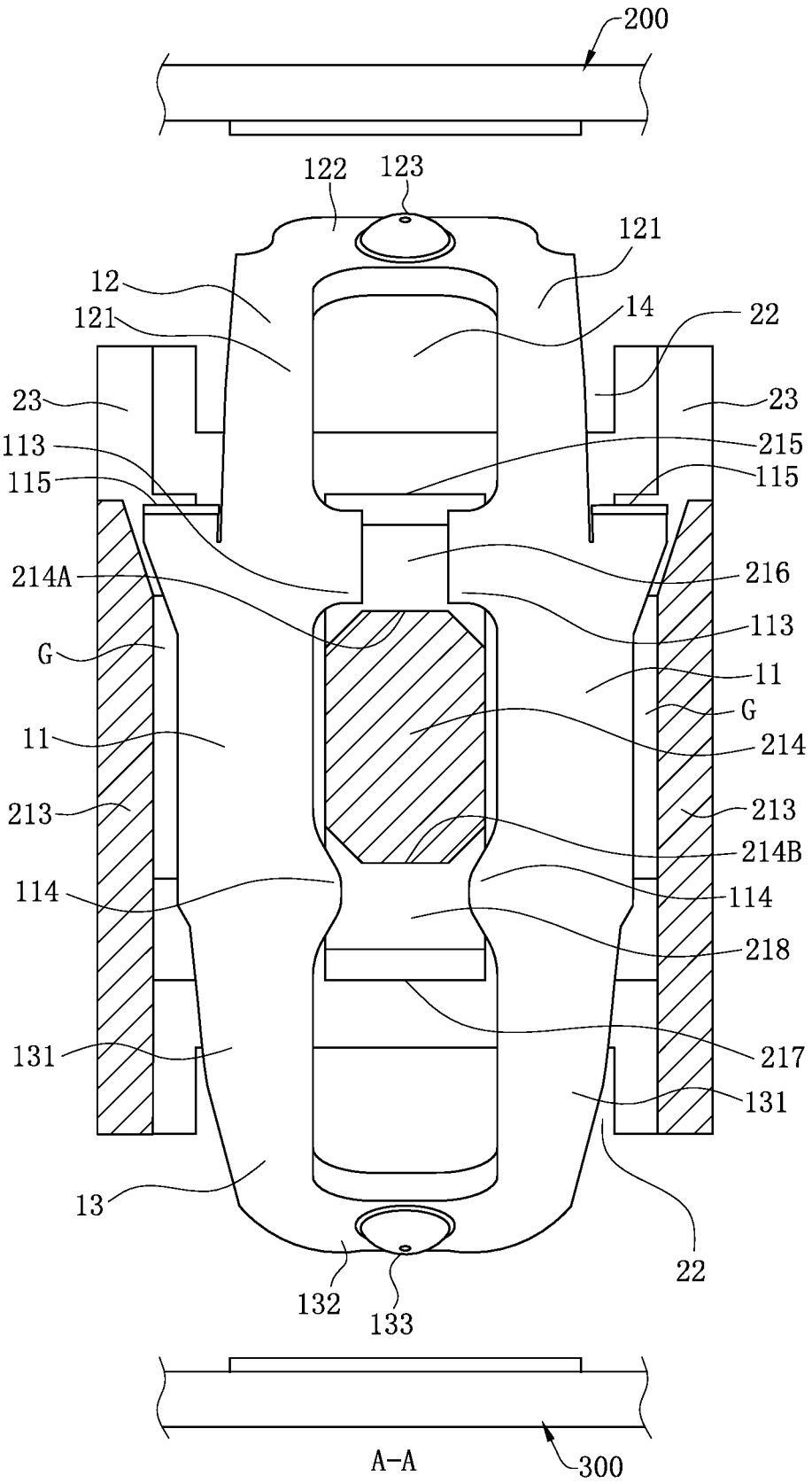
FIG. 5 is a sectional view of the electrical connector in FIG. 3 along a line A-A.

As shown in FIG. 1, FIG. 2 and FIG. 5, the body 2 is made of an insulating material, and has multiple accommodating holes 21 running vertically therethrough (only one accommodating hole is shown in the figure) to correspondingly accommodate the conductive terminals 1. A front side wall 211 of each of the accommodating holes 21 has a position limiting protruding block 214 protruding and extending backward and accommodated in the through slot 14. An upper surface of the position limiting protruding block 214 serves as an upper position limiting surface 214A, and a lower surface thereof serves as a lower position limiting surface 214B. A width of the position limiting protruding block 214 is greater than a distance between the two upper position limiting portions 113 and a distance between the two lower position limiting portions 114. An upper protruding portion 215 protrudes and extends upward from the upper position limiting surface 214A, and is located behind the upper position limiting portion 113. In the front-rear direction, an upper narrow slot 216 is formed between the upper protruding portion 215 and the front side wall 211 to accommodate the two upper position limiting portions 113 to limit the flat plate portion 11 from moving in the front-rear direction. A lower protruding portion 217 protrudes and extends downward from the lower position limiting surface 214B, and is located behind the lower position limiting portion 114. In the front-rear direction, a lower narrow slot 218 is formed between the lower protruding portion 217 and the front side wall 211 to accommodate the two lower position limiting portions 114 to limit the flat plate portion 11 from moving in the front-rear direction.

Figure 3:
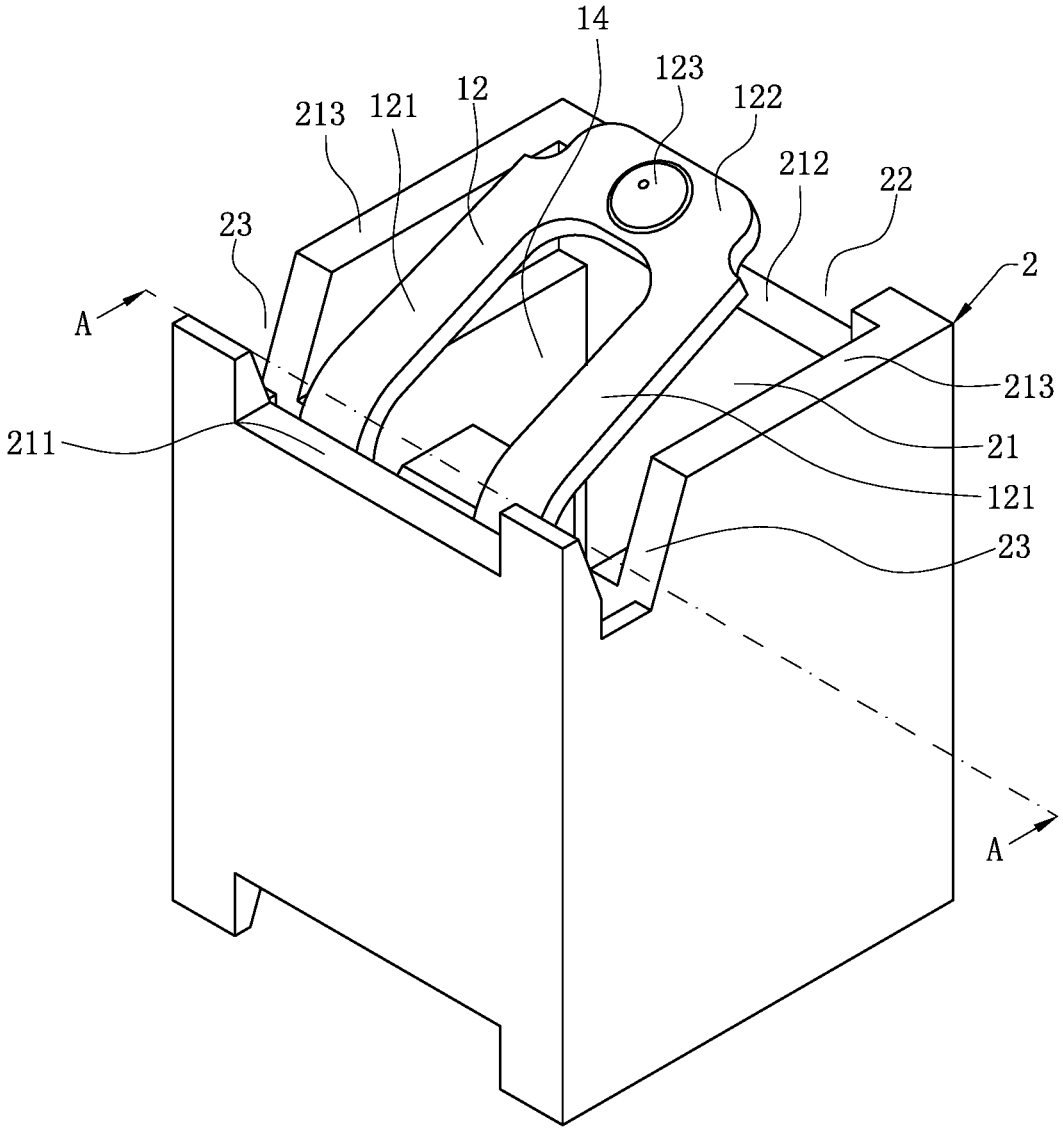
FIG. 3 is an assembled view of FIG. 1.

As shown in FIG. 2, FIG. 3 and FIG. 5, two reserved slots 22 are formed by recessing on an upper surface and a lower surface of the body 2. In the front-rear direction, the reserved slots 22 are provided on a rear side wall 212 of each accommodating hole 21 to provide reserved spaces for the upper elastic arm 12 and the lower elastic arm 13 to deform after the conductive terminal 1 mates with the first electronic component 200 and the second electronic component 300.

Figure 4:
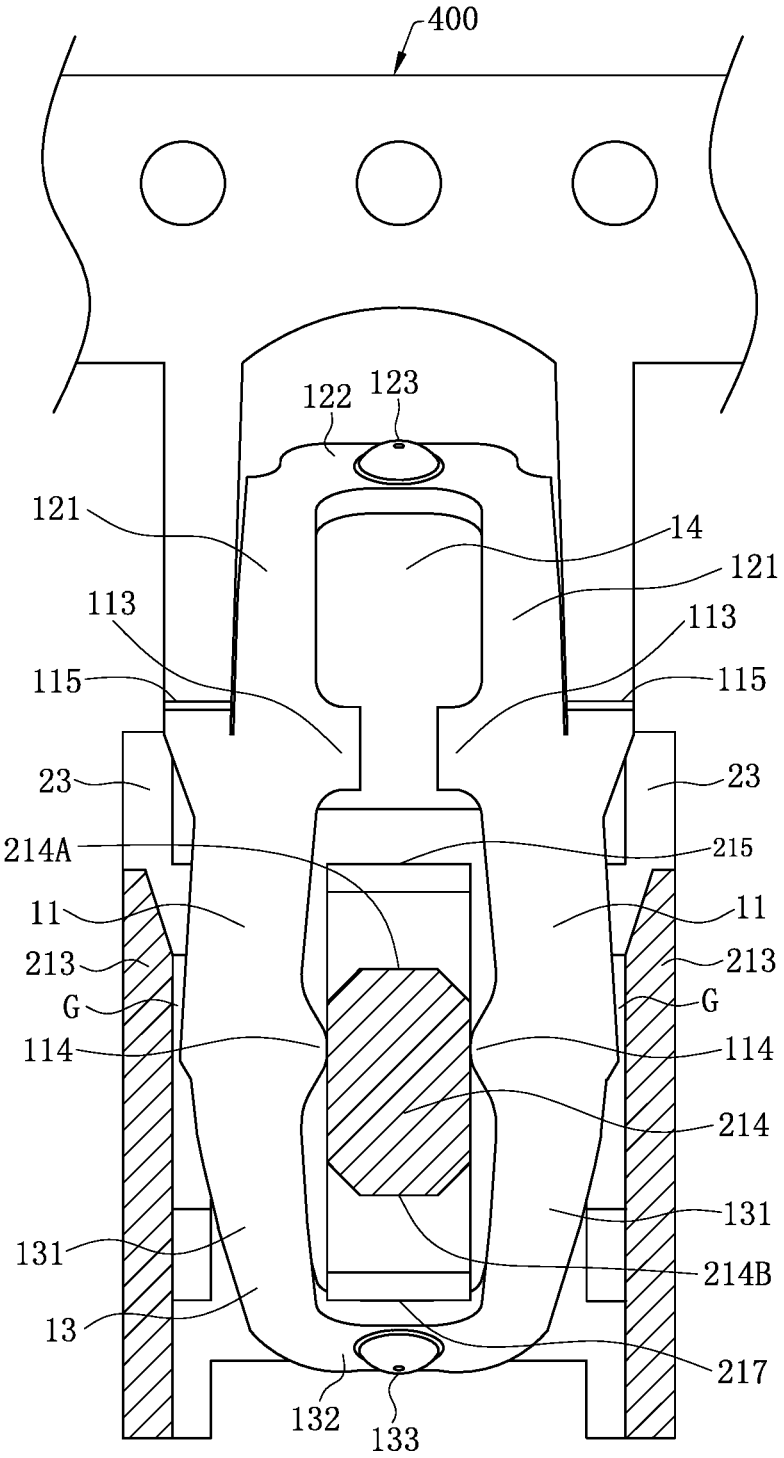
FIG. 4 is a schematic view of an assembling process of assembling a conductive terminal to the body in FIG. 1.

As shown in FIG. 1, FIG. 4 and FIG. 5, the body 2 is provided with two positioning slots 23 corresponding to each accommodating hole 21. The two positioning slots 23 are formed by recessing downward from the upper surface of the body 2. The two positioning slots 23 are in communication with the accommodating hole 21. The two positioning slots 23 are located on left and right side walls 213 of the accommodating hole 21. Each positioning slot 23 has an inner wall 230 located behind the strip connecting portion 115 to limit the corresponding strip connecting portion 115 from moving backward.

As shown in FIG. 4 and FIG. 5, the conductive terminal 1 is inserted into the corresponding accommodating hole 21 through the strip 400 downward from top thereof. In this process, the upper protruding portion 215 enters a space between the two lower branches 131, and the lower position limiting portions 114 enter the upper narrow slot 216. After the lower position limiting portions 114 are in contact with the upper position limiting surface 214A of the position limiting protruding block 214, the two lower position limiting portions 114 slide downward along their edges, and move away from two sides of the position limiting protruding block 214. Further, since there are gaps G between the flat plate portion 11 and the left and right side walls 213, the two lower position limiting portions 114 drive the flat plate portion 11 to expand along the width direction. After the two lower position limiting portions 114 pass through the position limiting protruding block 214, the lower position limiting portions 114 enter the lower narrow slot 218 and the upper position limiting portions 113 enter the upper narrow slot 216, and the flat plate portion 11 recovers under the action of its elasticity, such that the distance between the two lower position limiting portions 114 is less than the width of the position limiting protruding block 214 again. Finally, the strip 400 is broken to complete the assembling process of the conductive terminal 1. At this time, each of the upper position limiting portions 113 is located above the position limiting protruding block 214, and has a first gap from the upper position limiting surface 214A to limit the conductive terminal 1 from moving downward. Each of the lower position limiting portions 114 is located below the position limiting protruding block 214, and has a second gap from the lower position limiting surface 214B to limit the conductive terminal 1 from moving upward. In other words, each of the upper position limiting portions 113 is located above the upper position limiting surface 214A, and each of the lower position limiting portions 114 is located below the lower position limiting surface 214B, so as to limit a vertical movement of the conductive terminal 1. In addition, the upper position limiting portions 113 are accommodated in the upper narrow slot 216, and the lower position limiting portions 114 are accommodated in the lower narrow slot 218, thus limiting the conductive terminal 1 from moving in the front-rear direction.

FIG. 6 to FIG. 9 show an electrical connector 100 according to a second embodiment of the present invention.

Figure 6:
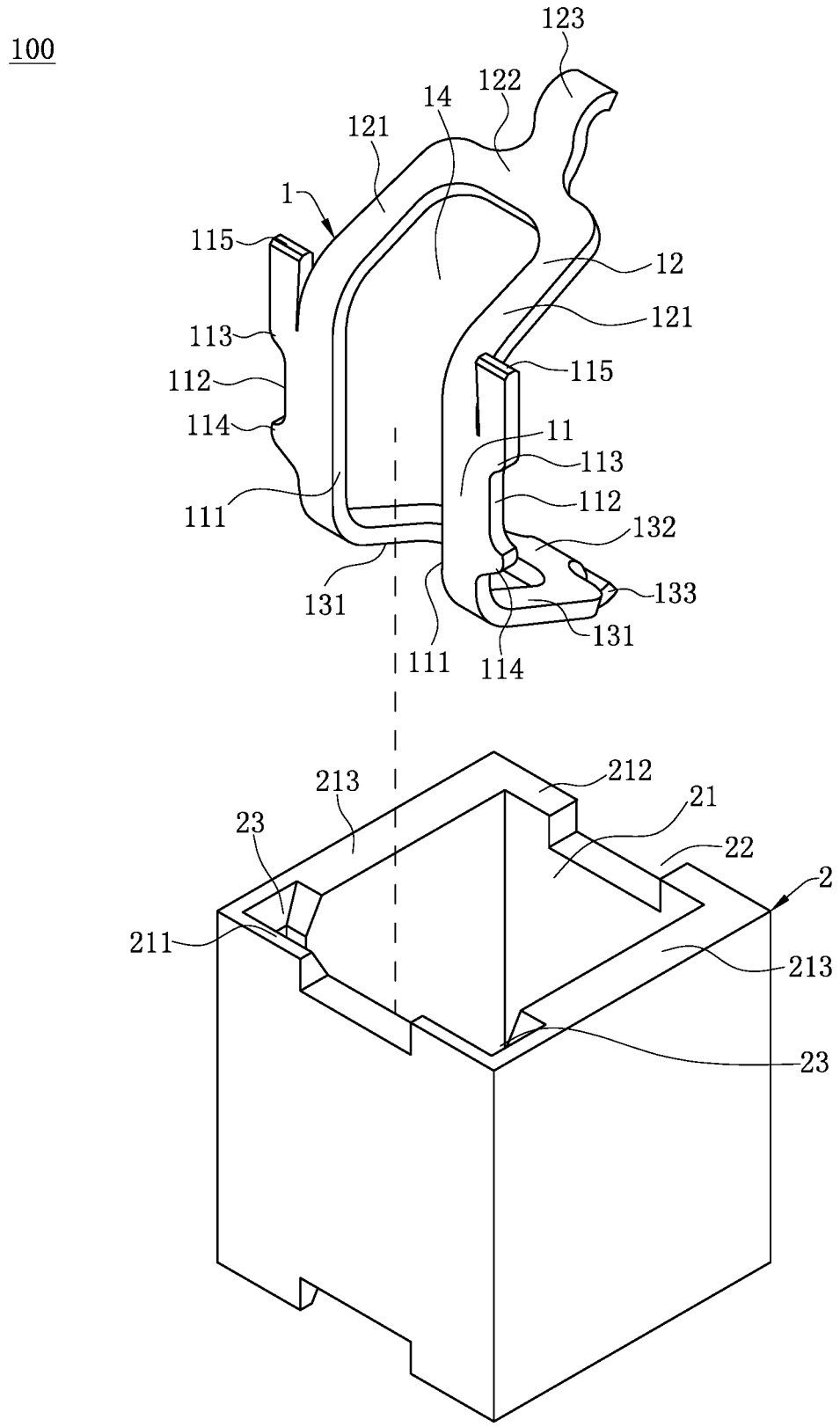
FIG. 6 is an exploded view of an electrical connector according to a second embodiment of the present invention.
Figure 7:
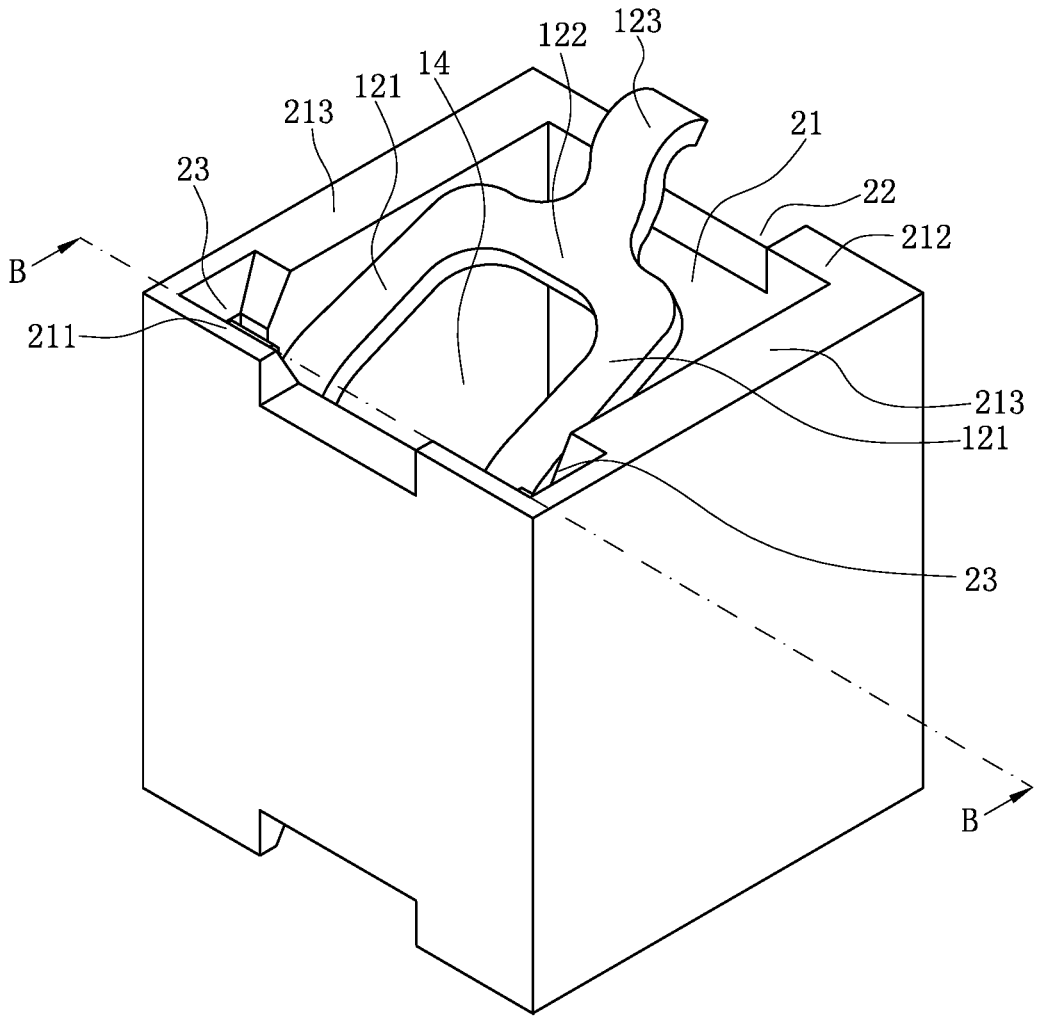
FIG. 7 is an assembled view of FIG. 6.
Figure 9:
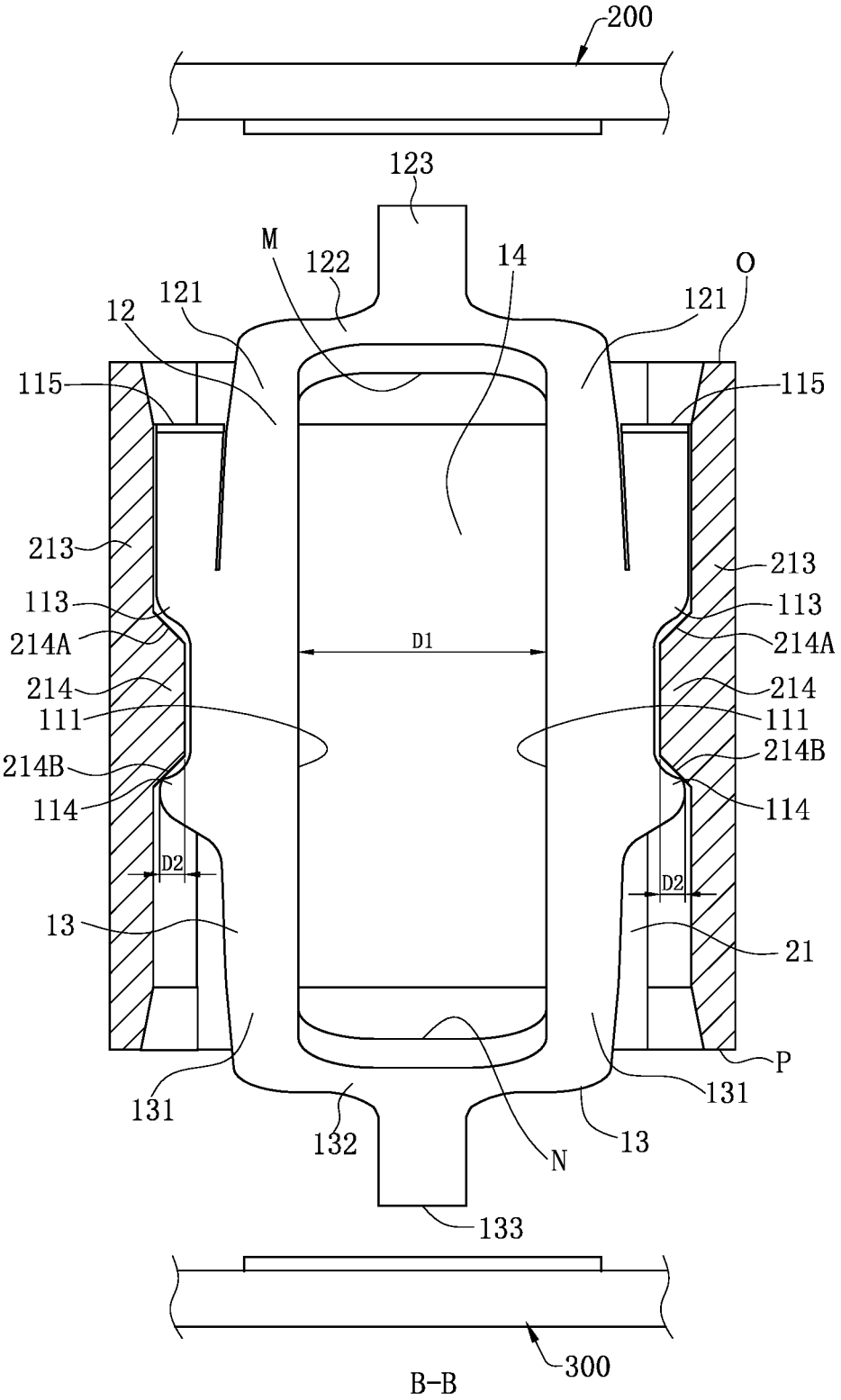
FIG. 9 is a sectional view of the electrical connector in FIG. 6 along a line B-B.
Figure 10:
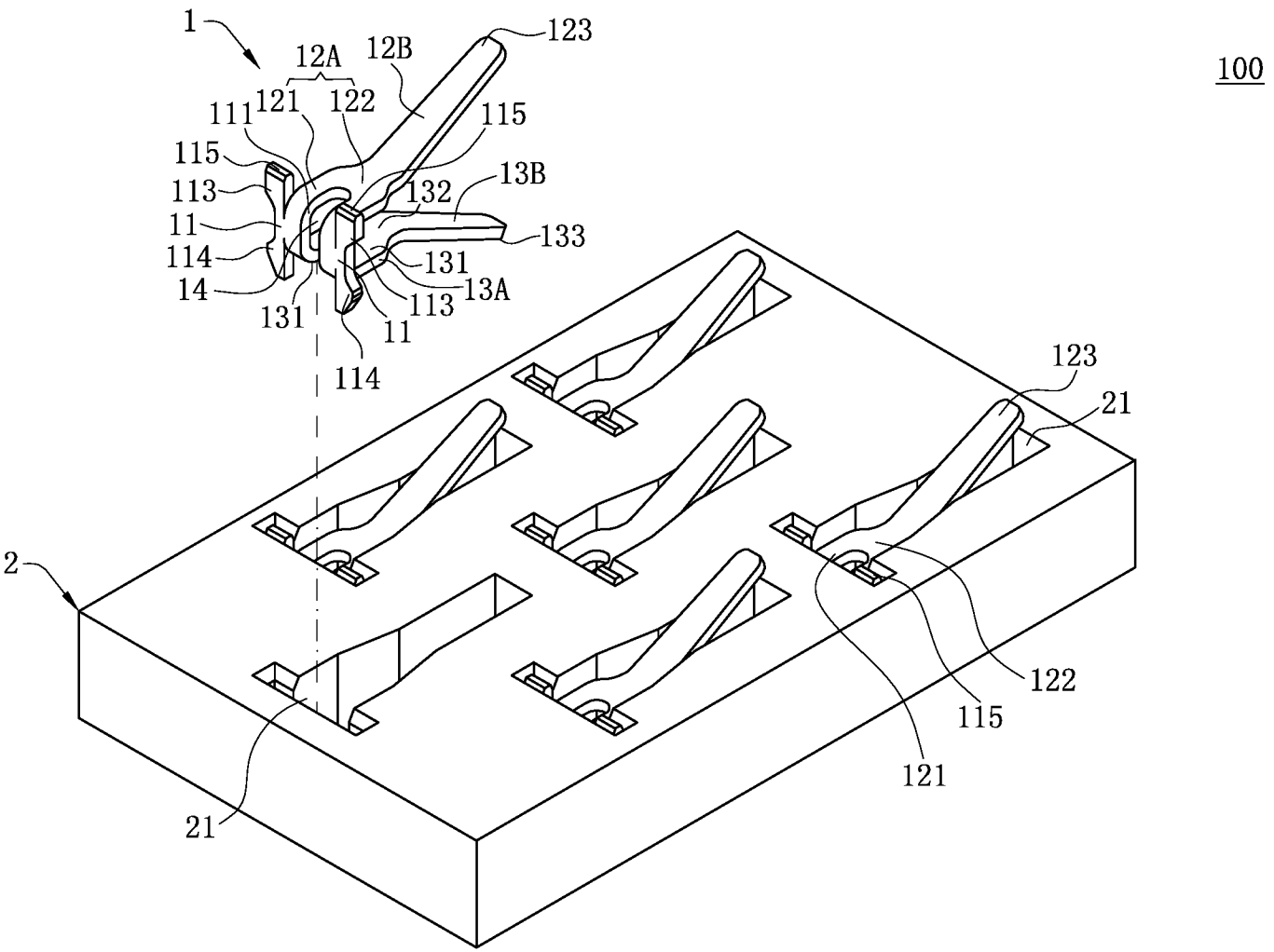
FIG. 10 is a partial exploded view of an electrical connector according to a third embodiment of the present invention.
Figure 11:
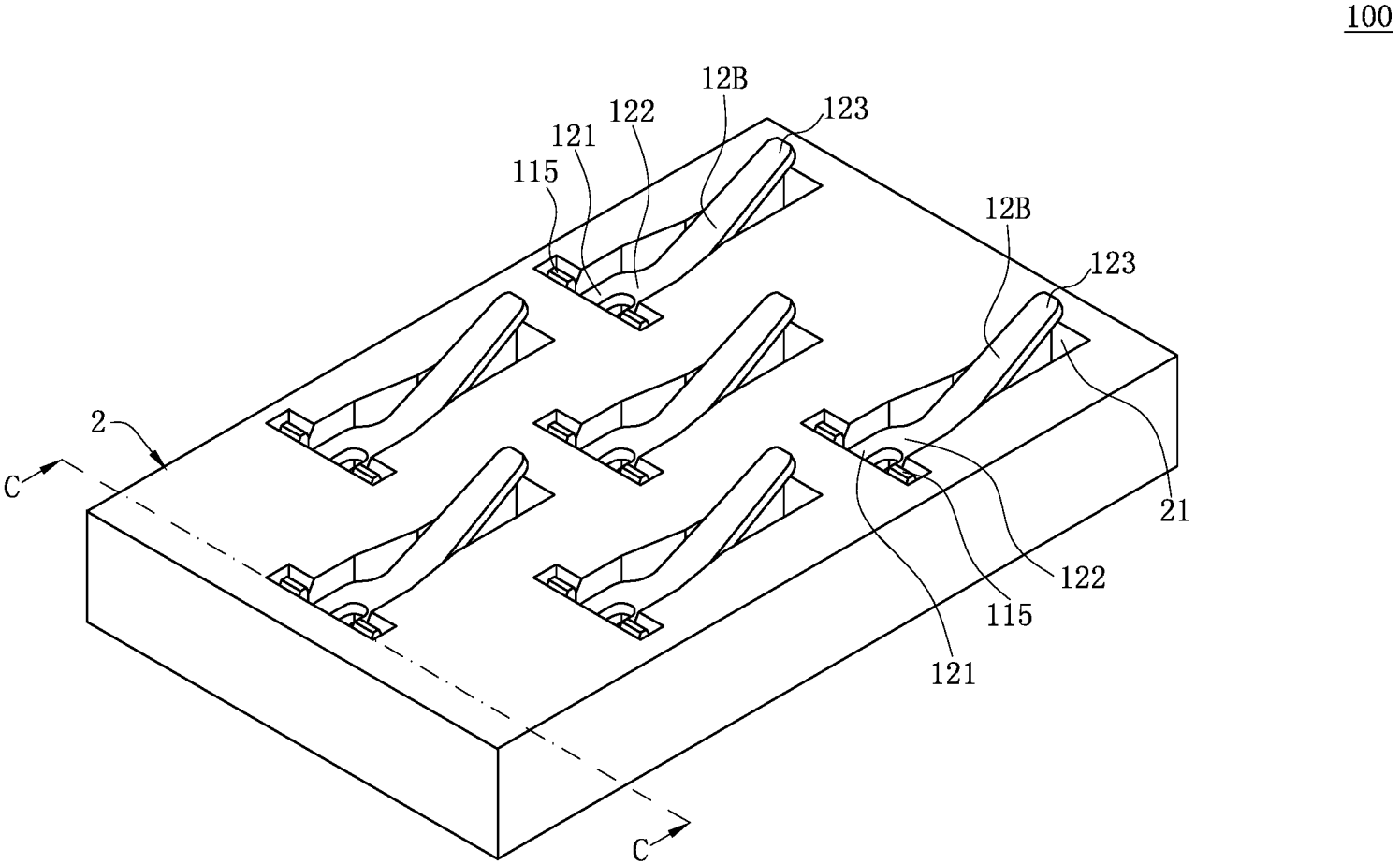
FIG. 11 is an assembled view of FIG. 10.
Figure 12:
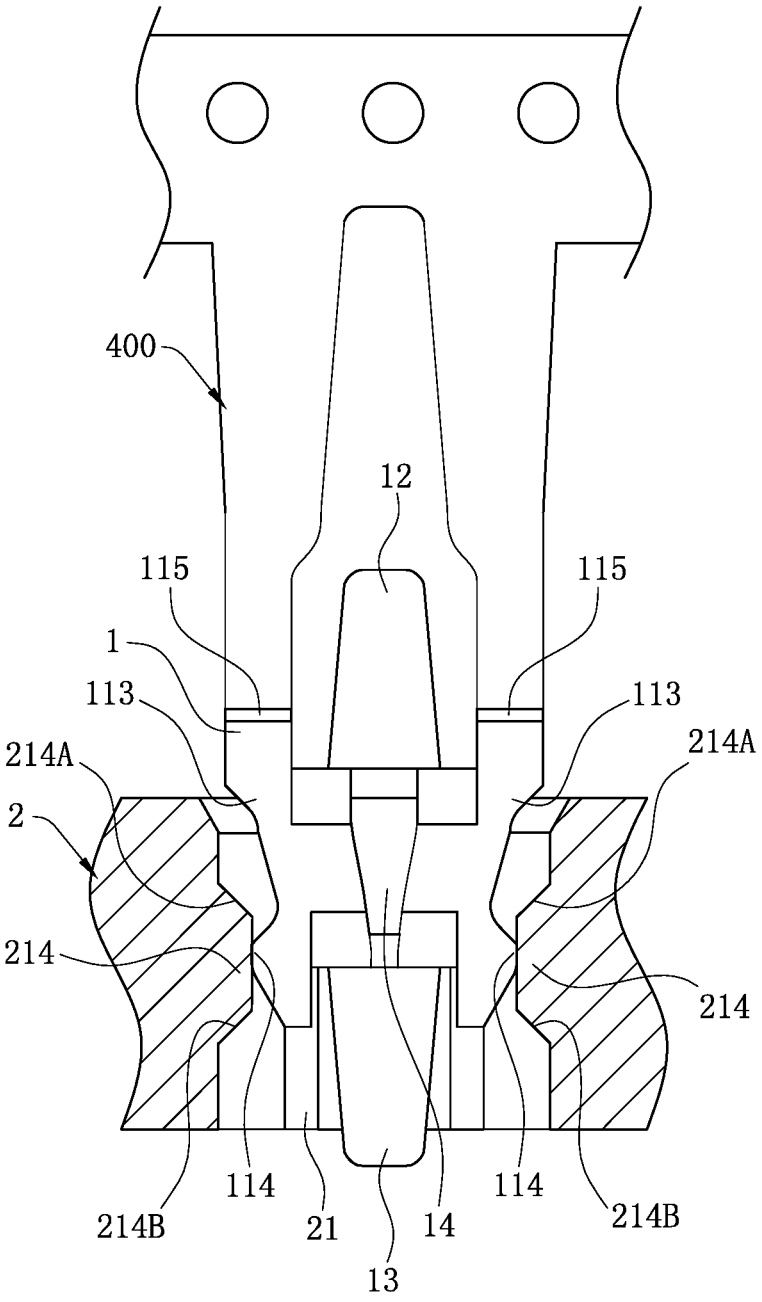
FIG. 12 is a schematic view of an assembling process of assembling a conductive terminal to the body in FIG. 10.
Figure 13:
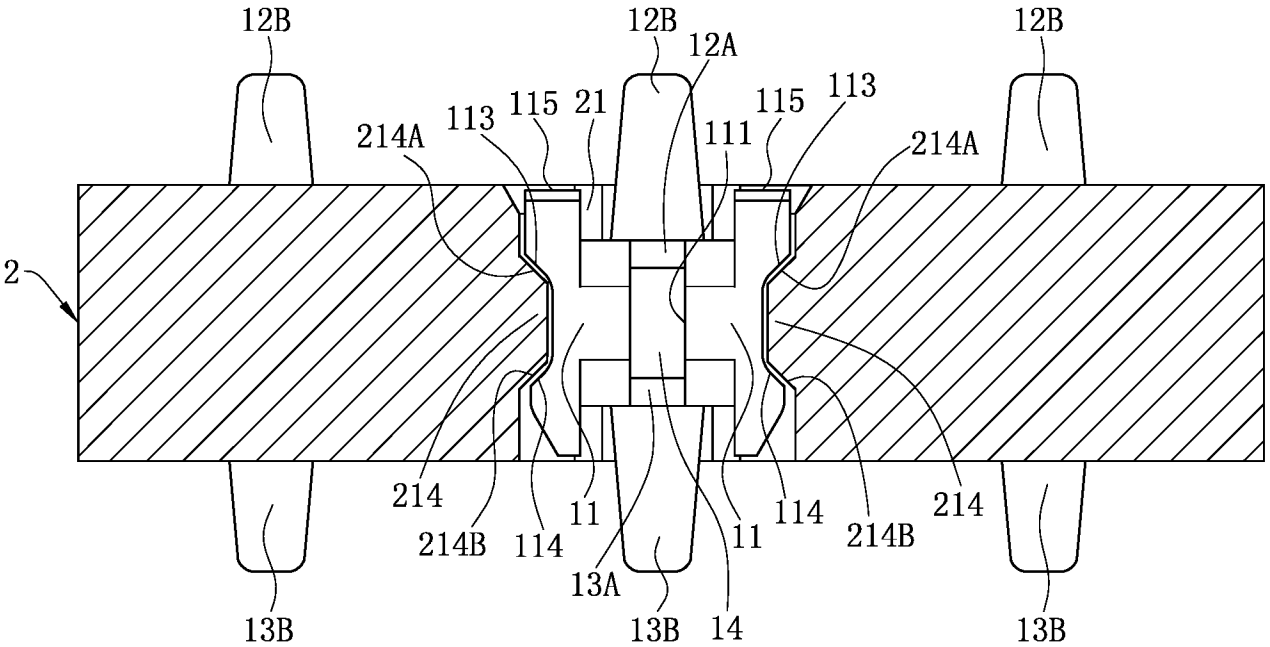
FIG. 13 is a sectional view of the electrical connector in FIG. 11 along a line C-C.

The major differences between this embodiment and the first embodiment exist in that: as shown in FIG. 6 and FIG. 9, the upper position limiting portions 113 and the lower position limiting portions 114 are provided on the outer side edges 112 of the flat plate portion 11, instead of the inner side edges 111. Correspondingly, the left and right side walls 213 of each of the accommodating holes 21 are respectively provided with the position limiting protruding blocks 214.

Figure 8:
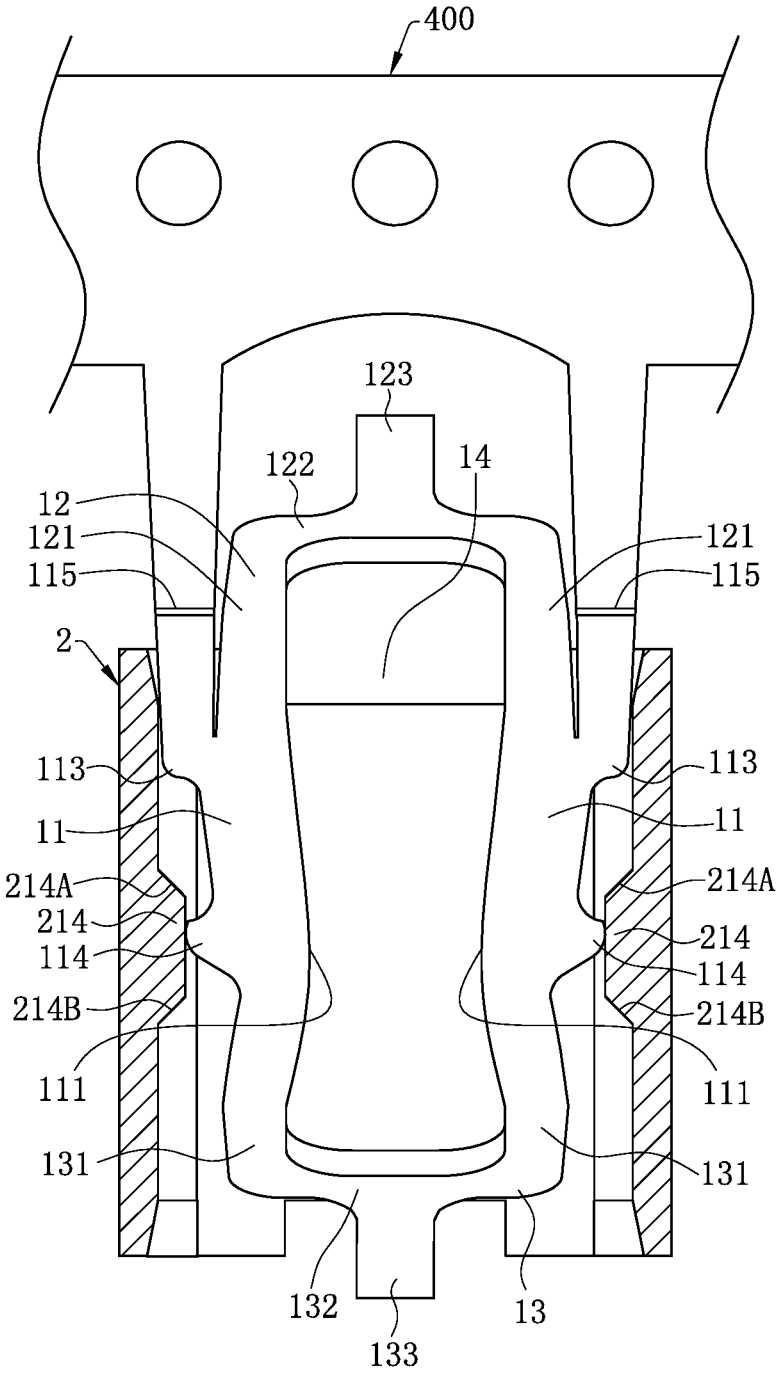
FIG. 8 is a schematic view of an assembling process of assembling a conductive terminal to the body in FIG. 6.

As shown in FIG. 8, the conductive terminal 1 is inserted into the corresponding accommodating hole 21 through the strip 400 downward from top thereof. In this process, the two lower position limiting portions 114 pass through the two position limiting protruding blocks 214, and drive two sides of the flat plate portion 11 to move close to the middle of the through slot 14.

As shown in FIG. 9, the through slot 14 forms an upper boundary M and a lower boundary N. The upper boundary M of the through slot 14 is located on a lower surface of the upper elastic arm 12, and is lower than an upper surface 0 of the body 2. The lower boundary N of the through slot 14 is located on an upper surface of the lower elastic arm 13, and is higher than a lower surface P of the body.

As shown in FIG. 9, after the lower position limiting portions 114 pass through the position limiting protruding blocks 214, the flat plate portion 11 recovers by its elasticity, such that the lower position limiting portions 114 extend below the position limiting protruding blocks 214 to enable the position limiting protruding blocks 214 to be stopped between the upper position limiting portions 113 and the lower position limiting portions 114 to limit the conductive terminal 1 from moving upward or downward. Finally, the strip 400 is broken to complete the assembling process of the conductive terminal 1.

As shown in FIG. 6 and FIG. 8, in the present embodiment, the strip connecting portion 115 is provided above the upper position limiting portions 113 and is connected downward to the corresponding upper position limiting portion 113, and is higher than the flat plate portion 11 by a certain height, so as to prevent the strip 400 from touching the upper elastic arm 12 in the process of breaking the strip 400. In addition, the upper contact portion 123 is formed by bending and extending backward from the upper connecting portion 122. The width of the upper contact portion 123 is less than the width of the through slot 14. The lower contact portion 133 is formed by bending and extending backward from the lower connecting portion 132. The width of the lower contact portion 133 is less than the width of the through slot 14. Compared with the first embodiment, the second embodiment is different in that the impedance of the conductive terminal corresponding to structures of the upper contact portion 123 and the lower contact portion 133 is higher. That is, the first embodiment and the second embodiment may be used in different occasions according to impedance requirements.

As shown in FIG. 8 and FIG. 9, in the present embodiment, the two sides of the flat plate portion 11 are both provided with the upper position limiting portions 113 and the lower position limiting portions 114. To prevent the two inner side edges 111 from touching each other in the assembling process, the width D1 of the through slot 14 is greater than twice of a width D2 of an overlapping portion of each position limiting protruding block 214 and the corresponding lower position limiting portion 114 in the vertical direction. In other words, the width D1 of the through slot 14 at a location correspondingly provided with two of the lower position limiting portions 114 is greater than an inward shrinking distance of the two of the lower position limiting portions 114 passing two of the position limiting protruding blocks 214. However, in another embodiment (which is not shown) where only one side of the conductive terminal 1 is provided with the upper position limiting portion 113, the lower position limiting portion 114 and the position limiting protruding block 214, it is possible to prevent the two inner side edges 111 from touching each other if the width D1 of the through slot 14 is greater than the width of an overlapping portion of the position limiting protruding block 214 and the lower position limiting portion 114 in the vertical direction. Other structures in the present embodiment are basically the same as those in the first embodiment, and are not further hereinafter elaborated.

FIG. 10 to FIG. 13 show an electrical connector 100 according to a third embodiment of the present invention. The major differences between this embodiment and the second embodiment exist in that: the upper elastic arm 12 includes an upper base 12A bending backward from the upper end of the flat plate portion 11 and then extending horizontally, and an upper oblique portion 12B extending upward and backward obliquely from the upper base 12A. The upper base 12A has the two upper branches 121 and the upper connecting portion 122. The upper contact portion 123 is provided at a free tail end of the upper oblique portion 12B. The lower elastic arm 13 includes a lower base 13A bending backward from the lower end of the flat plate portion 11 and then extending horizontally, and a lower oblique portion 13B extending downward and backward obliquely from the lower base 13A. The lower base 13A has the two lower branches 131 and the lower connecting portion 132. The lower contact portion 133 is provided at a tail end of the lower oblique portion 13B. In the present embodiment, the lower elastic arm 13 and the upper elastic arm 12 are also symmetrically provided. The strip connecting portion 115 is also provided above the upper position limiting portions 113 and is connected downward to the corresponding upper position limiting portion 113, and an upper end of the strip connecting portion 115 is higher than an upper end of the upper base 12A, so as to prevent the strip 400 from interfering with the elastic arms in the process of breaking the strip. The lower position limiting portions 114 extend downward beyond the lower base 13A. Other structures in the present embodiment are basically the same as those in the second embodiment, and are not further hereinafter elaborated.

To sum up, the electrical connector according to certain embodiments of the present invention has the following beneficial effects:

The flat plate portions 11 of the conductive terminals 1 are vertically movably limited in the accommodating holes 21, and in each conductive terminal 1, the through slot 14 extends from the upper elastic arm 12 through the flat plate portion 11 to the lower elastic arm 13, such that the flat plate portions 11 of the conductive terminals 1 are elastic. That is, each of the conductive terminals 1 is elastic through its entire length. Therefore, compared with the related art, the electrical connector 100 can shorten the upper elastic arms 12 and the lower elastic arms 13 of the conductive terminals 1 when the same elastic force is provided, thus reducing the heights of the conductive terminals 1, and facilitating ultra-thinning of the electrical connector 100. Further, in each conductive terminal 1, the through slot 14 extends from the upper elastic arm 12 through the flat plate portion 11 to the lower elastic arm 13, such that the width of the flat plate portion 11 is closer to the width of the upper elastic arm 12 and the width of the lower elastic arm 13 (relative to the situation where the through slot 14 runs through the upper elastic arm 12 and the lower elastic arm 13, but does not run through the flat plate portion 11), such that the impedance of each conductive terminal 1 from the upper elastic arm 12 through the flat plate portion 11 to the lower elastic arm 13 is relatively steady, which is conductive to improving high frequency. In addition, since the through slot 14 can enhance the elasticity of the flat plate portion 11, in a process of downward inserting each conductive terminal 1 into the corresponding accommodating hole 21, the lower position limiting portions 114 provided on the flat plate portion 11 does not damage the body 2 easily.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, configured to electrically connect a first electronic component with a second electronic component, the electrical connector comprising:

a body, having a plurality of accommodating holes running vertically therethrough, wherein each of the accommodating holes is provided with an upper position limiting surface and a lower position limiting surface; and a plurality of conductive terminals, vertically movably accommodated in the accommodating holes, wherein each respective conductive terminal of the conductive terminals comprises:

a flat plate portion, protrudingly provided with an upper position limiting portion and a lower position limiting portion, wherein the upper position limiting portion is located above the upper position limiting surface, and the lower position limiting portion is located below the lower position limiting surface, so as to limit a vertical movement of the respective conductive terminal;

an upper elastic arm formed by bending and extending backward and upward from the flat plate portion, wherein the upper elastic arm has an upper contact portion configured to upward abut the first electronic component; and a lower elastic arm formed by bending and extending backward and downward from the flat plate portion, wherein the lower elastic arm has a lower contact portion configured to downward abut the second electronic component, the upper elastic arm and the lower elastic arm are both located at a rear side of the flat plate portion, and a through slot extends from the upper elastic arm through the flat plate portion to the lower elastic arm, wherein the through slot extends and is in continuous communication through the upper elastic arm, the flat plate portion and the lower elastic arm, and the through slot passes through a location connecting the upper elastic arm and the flat plate portion and a location connecting the flat plate portion and the lower elastic arm.

2. The electrical connector according to claim 1, wherein the upper position limiting portion and the lower position limiting portion protrude and extend from an inner side of the flat plate portion into the through slot, each of the accommodating holes is provided with a position limiting protruding block accommodated in the through slot, the upper position limiting surface is provided on an upper surface of the position limiting protruding block, and the lower position limiting surface is provided on a lower surface of the position limiting protruding block.

3. The electrical connector according to claim 2, wherein an upper protruding portion is formed by extending upward from the position limiting protruding block, a lower protruding portion is formed by extending downward from the position limiting protruding block, the upper protruding portion is located behind the upper position limiting portion, and the lower protruding portion is located behind the lower position limiting portion, so as to limit the flat plate portion from moving backward.

4. The electrical connector according to claim 2, wherein the conductive terminal has two lower position limiting portions extending from two opposite inner sides of the flat plate portion, and a distance between the two lower position limiting portions is less than a width of the position limiting protruding block.

5. The electrical connector according to claim 1, wherein each of the conductive terminals further has a strip connecting portion protruding and extending from an outer side of the flat plate portion to be connected to a strip, the body has a plurality of positioning slots recessed downward from an upper surface of the body, the strip connecting portion of each of the conductive terminals is correspondingly accommodated in one of the positioning slots, and each of the positioning slots has an inner wall located behind the corresponding strip connecting portion to limit the corresponding strip connecting portion from moving backward.

6. The electrical connector according to claim 1, wherein:

the upper elastic arm forms two upper branches at two opposite sides of the through slot, an upper connecting portion connects the two upper branches, the upper contact portion protrudes upward from an upper surface of the upper connecting portion, a width of the upper contact portion is less than a width of the upper connecting portion, and a first interval exists between the upper contact portion and each of a left side edge and a right side edge of the upper connecting portion; and the lower elastic arm forms two lower branches at the two opposite sides of the through slot, a lower connecting portion connects the two lower branches, the lower contact portion protrudes downward from a lower surface of the lower connecting portion, a width of the lower contact portion is less than a width of the lower connecting portion, and a second interval exists between the lower contact portion and each of a left side edge and a right side edge of the lower connecting portion.

7. The electrical connector according to claim 1, wherein:

the upper elastic arm forms two upper branches at two opposite sides of the through slot, an upper connecting portion connects the two upper branches, the upper contact portion is formed by extending backward from the upper connecting portion, and a width of the upper contact portion is less than a width of the through slot; and the lower elastic arm forms two lower branches at the two opposite sides of the through slot, a lower connecting portion connects the two lower branches, the lower contact portion is formed by extending backward from the lower connecting portion, and a width of the lower contact portion is less than the width of the through slot.

8. The electrical connector according to claim 1, wherein the upper position limiting portion and the lower position limiting portion protrude from an outer side of the flat plate portion, each of the accommodating holes is provided with a position limiting protruding block, the upper position limiting surface is provided on an upper surface of the position limiting protruding block, the lower position limiting surface is provided on a lower surface of the position limiting protruding block, and a width of the through slot is greater than a width of an overlapping portion of the position limiting protruding block and the lower position limiting portion in a vertical direction.

9. The electrical connector according to claim 1, wherein the upper elastic arm comprises an upper base bending backward from the flat plate portion and then extending horizontally, and an upper oblique portion extending upward and backward obliquely from the upper base, the upper contact portion is provided at a free tail end of the upper oblique portion, and the through slot extends to the upper base but does not reach the upper oblique portion.

10. The electrical connector according to claim 9, wherein each of the conductive terminals further has a strip connecting portion configured to be connected to a strip, the strip connecting portion is located above the upper position limiting portion, and an upper end of the strip connecting portion is higher than an upper end of the upper base.

11. The electrical connector according to claim 1, wherein the through slot of each respective conductive terminal is formed by removing a material of each respective conductive terminal.

12. The electrical connector according to claim 1, wherein the through slot forms an upper boundary on a lower surface of the upper elastic arm, and the upper boundary is lower than an upper surface of the body.

13. The electrical connector according to claim 1, wherein the through slot forms a lower boundary on an upper surface of the lower elastic arm, and the lower boundary is higher than a lower surface of the body.

14. The electrical connector according to claim 1, wherein the flat plate portion is provided with two upper position limiting portions and two lower position limiting portions, each of a left side and a right side of the flat plate portion has one of the two upper position limiting portions and one of the two lower position limiting portions, each of a left side and a right side of each of the accommodating holes has a position limiting protruding block, the upper position limiting surface is provided on an upper surface of the position limiting protruding block, the lower position limiting surface is provided on a lower surface of the position limiting protruding block, and a width of the through slot is greater than a sum of a width of an overlapping portion of the position limiting protruding block at the left side of each of the accommodating holes and a corresponding one of the two lower position limiting portions in a vertical direction and a width of an overlapping portion of the position limiting protruding block at the right side of each of the accommodating holes and a corresponding one of the two lower position limiting portions in the vertical direction.

15. The electrical connector according to claim 1, wherein the flat plate portion is provided with two upper position limiting portions and two lower position limiting portions, each of a left side and a right side of the flat plate portion has one of the two upper position limiting portions and one of the two lower position limiting portions, each of a left side and a right side of each of the accommodating holes has a position limiting protruding block, the upper position limiting surface is provided on an upper surface of the position limiting protruding block, the lower position limiting surface is provided on a lower surface of the position limiting protruding block, and a width of the through slot is greater than twice the width of the overlapping portion of the position limiting protruding block at each of the left side and the right side of each of the accommodating holes and the corresponding one of the two lower position limiting portions in a vertical direction.

* * * * *